US006544094B1

(12) United States Patent
Maddocks et al.

(10) Patent No.: US 6,544,094 B1
(45) Date of Patent: Apr. 8, 2003

(54) TOY WITH SKIN COUPLED TO MOVABLE PART

(75) Inventors: Richard Maddocks, Barrington, RI (US); Peter Hall, Norfolk (GB); Adam B. Craft, Mansfield, MA (US); Jeffrey H. Olson, Pawtucket, RI (US)

(73) Assignee: Hasbro, Inc., Pawtucket, RI (US)

( * ) Notice: Subject to any disclaimer, the term of this patent is extended or adjusted under 35 U.S.C. 154(b) by 0 days.

(21) Appl. No.: 09/920,327

(22) Filed: Aug. 2, 2001

Related U.S. Application Data

(60) Provisional application No. 60/222,663, filed on Aug. 3, 2000.

(51) Int. Cl.[7] ..... A63H 30/00

(52) U.S. Cl. ..... 446/175; 446/301; 446/330; 446/337; 446/343; 446/392

(58) Field of Search ..... 46/321, 100, 175, 46/268, 298, 300, 301, 330, 337, 343, 370, 371, 376, 373, 375, 372, 389, 392

(56) References Cited

U.S. PATENT DOCUMENTS

| | | | | |
|---|---|---|---|---|
| 3,638,351 | A | | 2/1972 | Kosicki et al. |
| 3,755,960 | A | | 9/1973 | Tepper et al. |
| 3,881,275 | A | * | 5/1975 | Baulard-Cogan |
| 3,912,694 | A | | 10/1975 | Chiappe et al. |
| 4,074,460 | A | * | 2/1978 | Thorn et al. |
| 4,139,968 | A | | 2/1979 | Milner |
| 4,221,927 | A | | 9/1980 | Dankman et al. |
| 4,245,430 | A | | 1/1981 | Hoyt |
| 4,249,338 | A | | 2/1981 | Wexler |
| 4,267,606 | A | | 5/1981 | Stelter et al. |
| 4,318,245 | A | | 3/1982 | Stowell et al. |
| 4,375,106 | A | | 2/1983 | Voll |
| 4,439,161 | A | | 3/1984 | Wiggins et al. |
| 4,451,911 | A | | 5/1984 | Klose et al. |
| 4,516,950 | A | | 5/1985 | Berman et al. |
| 4,591,248 | A | | 5/1986 | Freeman |
| 4,605,380 | A | * | 8/1986 | Camm et al. |
| 4,654,659 | A | | 3/1987 | Kubo |
| 4,659,919 | A | | 4/1987 | Price |
| 4,665,640 | A | | 5/1987 | Forsse et al. |
| 4,673,371 | A | | 6/1987 | Furukawa |
| 4,675,519 | A | | 6/1987 | Price |
| 4,696,653 | A | | 9/1987 | McKeefery |
| 4,740,186 | A | | 4/1988 | Sirota |
| 4,754,133 | A | | 6/1988 | Bleich |
| 4,799,171 | A | | 1/1989 | Cummings |
| 4,802,879 | A | | 2/1989 | Rissman et al. |
| 4,809,335 | A | | 2/1989 | Rumsey |
| 4,840,602 | A | | 6/1989 | Rose |
| 4,850,930 | A | | 7/1989 | Sato et al. |
| 4,857,030 | A | | 8/1989 | Rose |

(List continued on next page.)

FOREIGN PATENT DOCUMENTS

| | | |
|---|---|---|
| DE | 3345978 A 1 | 6/1985 |
| GB | 2 256 598 A | 12/1992 |
| WO | WO 96/03190 A1 | 2/1996 |
| WO | WO 97/41936 | 11/1997 |

OTHER PUBLICATIONS

Trade Walker Limited, Thermoplastic Rubber, Feb. 27, 1998, Korea.

* cited by examiner

*Primary Examiner*—Derris H. Banks
*Assistant Examiner*—Ali Abdelwahed
(74) *Attorney, Agent, or Firm*—Fish & Richardson, P.C.

(57) ABSTRACT

A toy includes a body that has a fixed part, a movable part secured to the fixed part, and a flexible elastomer skin. The flexible elastomer skin covers at least a portion of the fixed part and couples to the movable part. The flexible skin moves in response to movement of the movable part.

25 Claims, 13 Drawing Sheets

U.S. PATENT DOCUMENTS 4,864,607 A 9/1989 Mitamura et al.
4,900,289 A 2/1990 May et al.
4,923,428 A 5/1990 Curran
4,949,327 A 8/1990 Forsse et al.
5,011,449 A 4/1991 Handy et al.
5,267,886 A 12/1993 Wood et al.
5,279,514 A 1/1994 Lacombe et al.
5,281,180 A 1/1994 Lam et al.
5,288,069 A 2/1994 Matsumoto
5,324,225 A 6/1994 Satoh et al.
5,375,839 A 12/1994 Pagani
5,376,038 A 12/1994 Arad et al.
5,468,172 A 11/1995 Basile
5,471,192 A 11/1995 Dash
5,700,178 A 12/1997 Cimerman et al.
5,816,885 A 10/1998 Goldman et al.
6,048,209 A * 4/2000 Bailey ..... 434/267
6,074,270 A * 6/2000 Wilcox et al. ..... 446/370
6,149,490 A * 11/2000 Hampton et al. ..... 446/353
6,193,580 B1 * 2/2001 Albert et al. ..... 446/297
6,322,420 B1 * 11/2001 Daniellian ..... 446/300

TOY WITH SKIN COUPLED TO MOVABLE PART

CROSS REFERENCE TO RELATED APPLICATION

This application claims benefit to U.S. Provisional Application No. 60/222,663, filed Aug. 3, 2000, which is incorporated by reference.

TECHNICAL FIELD

This invention relates to interactive toys.

BACKGROUND

Toys have been developed that can talk and have moving body parts. One goal in developing these toys is to provide a plaything that simulates lifelike actions and speech.

SUMMARY

A toy is provided with a realistic skin that flexes, wrinkles, and functions in response to an economical mechanism that draws a low amount of current and provides an acceptable toy battery life. The skin may be coupled, for example, to facial features of the toy, such that movement of the facial features provides corresponding movement of the skin, which results in lifelike animation. By contrast, many prior art toys provide less lifelike animation. For example, some prior art toys employ eyelids made of hard plastic that disappear inside the head when the eyes of the toy are open. As another example, other prior art toys employ lips made of hard plastic that move apart and into the head when the mouth opens.

An unrealistic and thick skin for toys may be produced by rotomolding polyvinyl chloride (PVC). However, skin made of PVC remains rigid and unable to move, flex, or wrinkle like real skin. Accordingly, in order to achieve a minimal realistic animation using this material, a high cost motor, which draws high current, is needed to move the thick skin. Because of this, battery life of the toy is reduced, making such design prohibitive. Traditionally, users would sacrifice realistic toy animation in exchange for cheapness and convenience.

In one aspect, a toy includes a body that has a fixed part, a movable part secured to the fixed part, and a flexible elastomer skin. The flexible elastomer skin covers at least a portion of the fixed part and couples to the movable part. The flexible elastomer skin moves in response to movement of the movable part.

Embodiments may include one or more of the following features. For example, the flexible elastomer skin may have a hardness in a range of about 10 to about 15 durometer on a shore A scale. The flexible elastomer skin may be a thermoplastic. The flexible elastomer skin may have a thickness of from about 0.8 mm to about 1.2 mm. The flexible elastomer skin may have a specific gravity of from about 0.9 to about 1.05.

The toy may include an attachment piece that couples the flexible elastomer skin to the movable part. In this case, the flexible elastomer skin is insert molded to the attachment piece and the attachment piece is connected to the movable part.

The flexible elastomer skin may be made of styrene butadiene styrene or of styrene ethylene-butylene styrene. Alternatively, the flexible elastomer skin may be made from a combination of styrene butadiene styrene and styrene ethylene-butylene styrene.

The toy may further include sensors that detect sensory inputs and generate signals. The sensors may include motion, auditory, and light sensors. The sensors may include sensors that detect pressure applied to the toy. The sensors may include sensors that detect a tilting of the toy.

The toy may include an electro-mechanical system that drives the movable part, and a controller that detects the generated signals from the sensors. In response to the generated signals, the controller activates the electro-mechanical system to move the movable part.

The fixed part may be shaped like a head. The movable part may be shaped like an eye, an ear, or a mouth.

The flexible elastomer skin that covers at least the portion of the fixed part may be molded to the portion of the fixed part. Alternatively, the flexible elastomer skin that covers at least the portion of the fixed part may be removable from the portion of the fixed part.

In another general aspect, a toy includes a body including a fixed part, a movable part secured to the fixed part, and a front facial area. The front facial area covers at least a portion of the fixed part. The front facial area includes a rigid piece that attaches the front facial area to the portion of the fixed part, and a flexible elastomer skin molded to the rigid piece and coupled to the movable part. The flexible elastomer skin coupled to the movable part moves in response to movement of the movable part.

Implementations may include one or more of the following features. For example, the front facial area may also include an attachment piece that couples the flexible elastomer skin to the movable part. In this case, the flexible elastomer skin may be molded to the attachment piece.

In another aspect, a method of making an interactive toy includes constructing a body that includes a fixed part, and securing a movable part to the fixed part. A prepared elastomer is injected into a mold and cured to form a flexible elastomer skin. The mold is removed from the flexible elastomer skin. The flexible elastomer skin is applied to at least a portion of the fixed part, and coupled to the movable part such that the flexible elastomer skin moves in a realistic manner when the underlying movable part moves.

In another aspect, a method of making an interactive toy includes constructing a body that includes a fixed part, and securing a movable part to the fixed part. A prepared elastomer and a rigid piece are loaded into a mold cavity formed by first and second mold pieces. The elastomer is cured to form a flexible elastomer skin, at least a portion of which is formed on the rigid piece. The first and second mold pieces are removed from the flexible elastomer skin. Then, the rigid piece is attached to at least a portion of the fixed part. The flexible elastomer skin is coupled to the movable part such that the flexible elastomer skin moves in a realistic manner when the underlying movable part moves.

The details of one or more implementations are set forth in the accompanying drawings and the description below. Other features and advantages will be apparent from the description, the drawings, and the claims.

DESCRIPTION OF DRAWINGS

Like reference symbols in the various drawings indicate like elements.

DETAILED DESCRIPTION

Figure 1:
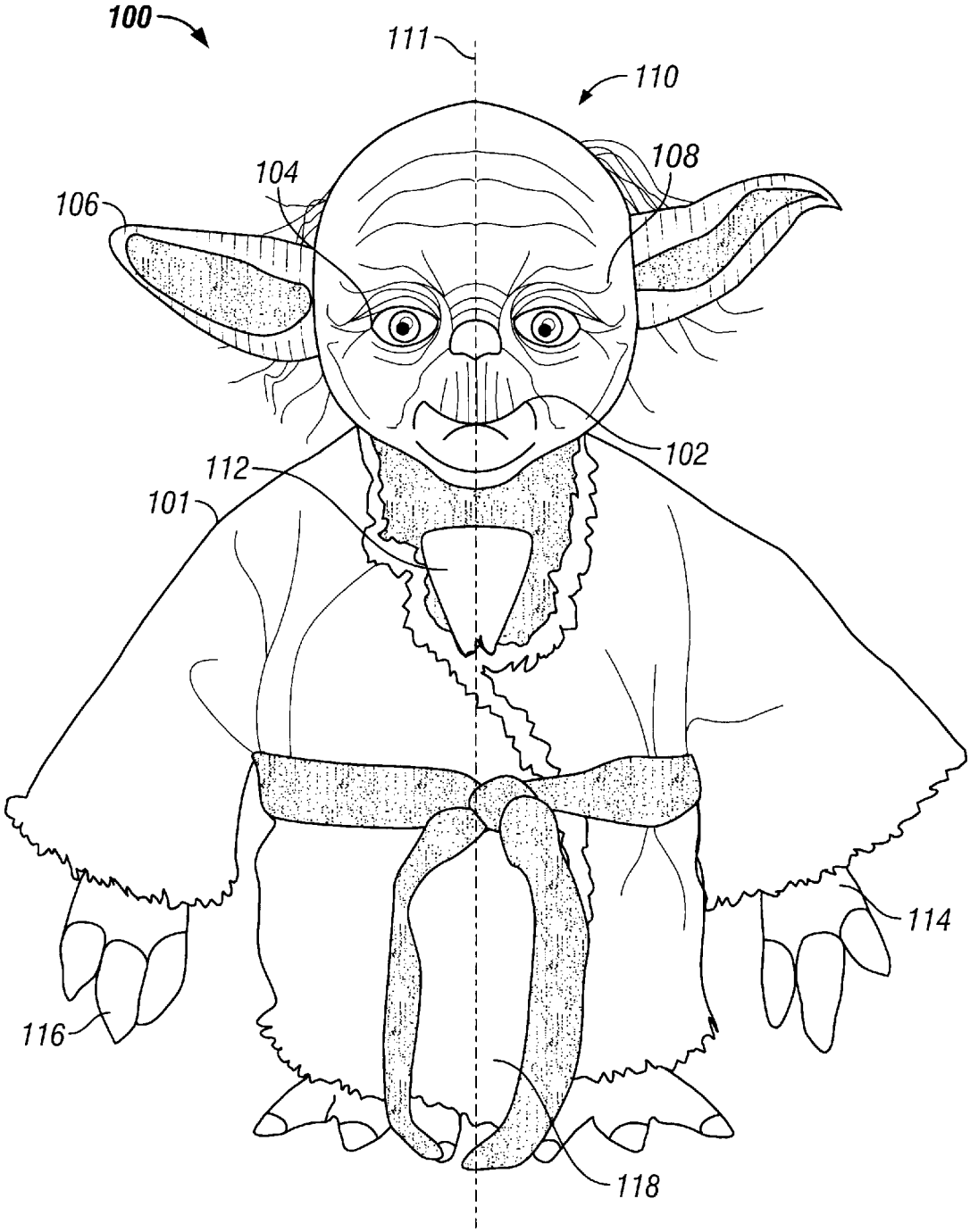
FIG. 1 is a front view of a toy that includes a realistic skin that covers one or more movable body parts.

Referring to FIG. 1, a realistic toy 100 includes a body 101 with a head 110 having movable body parts in the form of a mouth 102, eyes 104, and ears 106. The body 101 has a design including respective housing halves of plastic material that are attached together in alignment about a longitudinal axis 111 of the body 101. The size and weight of the body 101 is determined by components housed within the body 101, and the level of sophistication designed into the toy 100. In general, the toy 100 is designed to achieve a highly lifelike appearance while maintaining a compact size and a low cost. One implementation of the toy 100 has a dimension between an upper and lower end along the longitudinal axis 111 of approximately 7½ inches, and a preferred dimension at its widest portion laterally transverse to the axis 111 of approximately 3 ½ inches.

The body parts 102, 104, 106, are controlled and coordinated in their movements in response to external sensed conditions. The control and coordination of the movements of the body parts provide a highly lifelike toy 100 to permit high levels of interaction with the user.

The realistic toy 100 includes a skin 108 that covers the head 110 such that parts of the skin are attached to portions of one or more movable body parts 102, 104, 106. In one implementation, the skin 108 covers a portion of the mouth 102, the eyes 104, and the ears 106, and is molded to resemble lips, eyelids, and ears.

The body parts 102, 104, 106 and the body 101 may be formed of hard polymers to permit efficient movement of the body parts. In contrast, the skin 108 is formed from a soft, durable, flexible thermoplastic elastomer. In this way, the skin moves in accordance with movement of the one or more covered body parts 102, 104, 106 to which it is attached to provide a more realistic toy 100. The skin 108 will be described in greater detail below.

The toy body parts 102, 104, 106 are controlled and coordinated in response to sensory inputs detected by various sensors 112, 114, 116, 118 provided at various positions within the body 101 of the toy 100. The various sensors may include a light sensor 112 positioned at a front of the toy 100, left and right hand sensors 114, 116, respectively, positioned in the hands of the toy 100 to detect direct applied pressure, and an internal sensor 118 that detects whether the toy 100 is tilted from a basic position. The sensors may detect any stimulus from the user, including stimuli from other electro-mechanical devices or toys.

Figure 2:
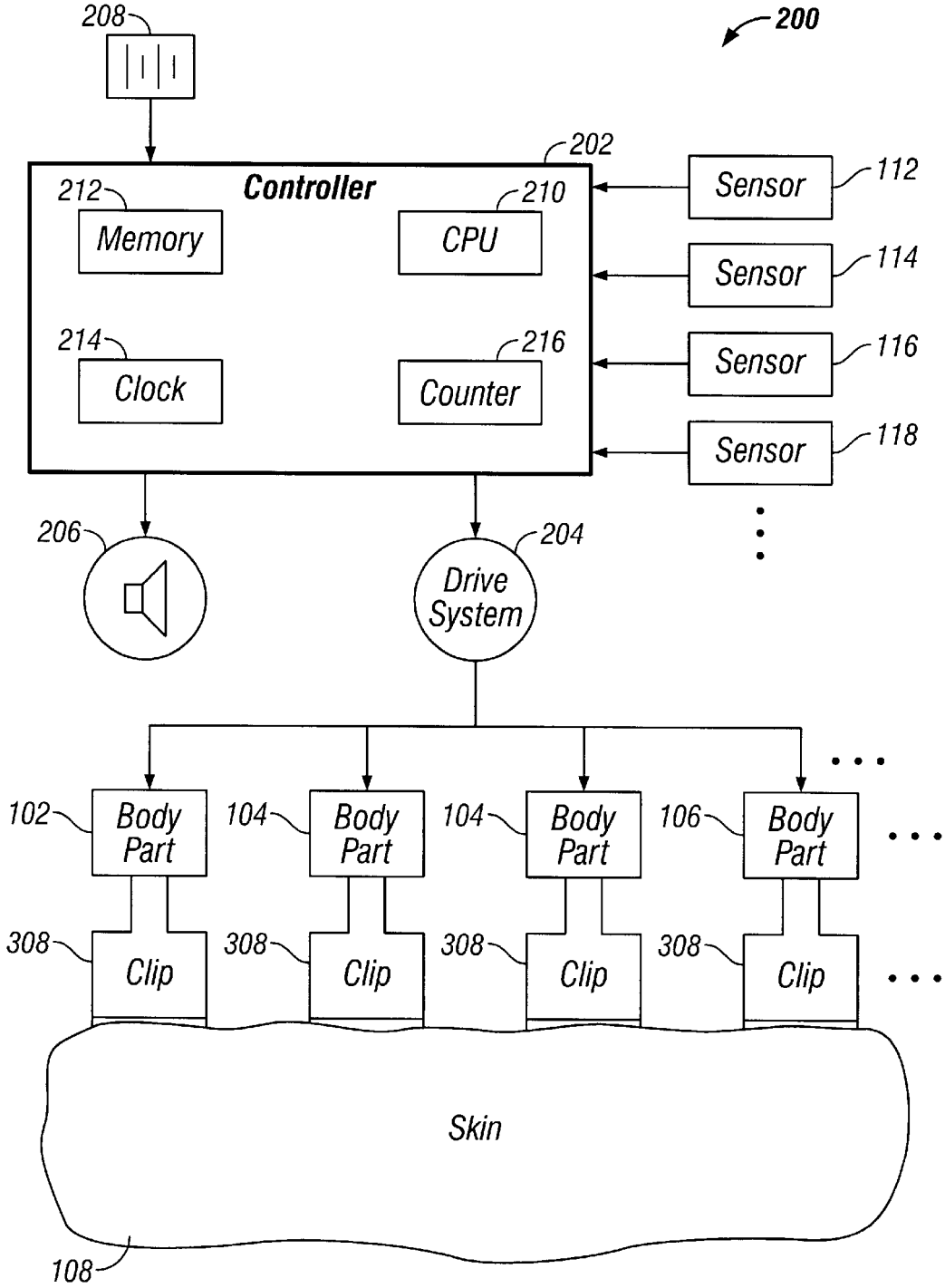
FIG. 2 is a block diagram of operating components of the toy of FIG. 1.

Referring also to a block diagram 200 of FIG. 2, in response to the detected conditions, the sensors generate a signal that is input to a controller 202 that controls an electro-mechanical drive system 204 and a speaker 206. The controller 202 receives power from a power source such as a battery 208. The electro-mechanical drive system 204 is coupled directly to the body parts 102, 104, 106 to generate the desired coordinated movements.

The body 101 of the toy 100 houses the controller 202, electro-mechanical system 204, the speaker 206, the battery 208, and the sensors.

The electro-mechanical system 204 uses a single, low power (reversible) electric motor and an associated gearing system to control the body parts and provide lifelike movements while providing for an acceptable battery life. Such a gearing system is included in the well-known Furby™ toy available from Tiger Electronics.

The controller 202 receives input from the power source 208 and the sensors 112, 114, 116, 118. Based on this input, the controller 202 controls the speaker 206 and the electro-mechanical system 204 to make the toy 100 appear to talk in conjunction with movement of the body parts 102, 104, 106. The controller 202 performs these tasks using additional information obtained from a processor 210, memory 212, a clock 214, and a counter 216. In this way, the toy 100 provides seemingly intelligent and lifelike interaction with the user. For example, the toy 100 exhibits different physical and emotional states that are associated with different coordinated positions of the body parts 102, 104, 106 and sounds, words and/or exclamations generated by the controller 202.

Figure 3:
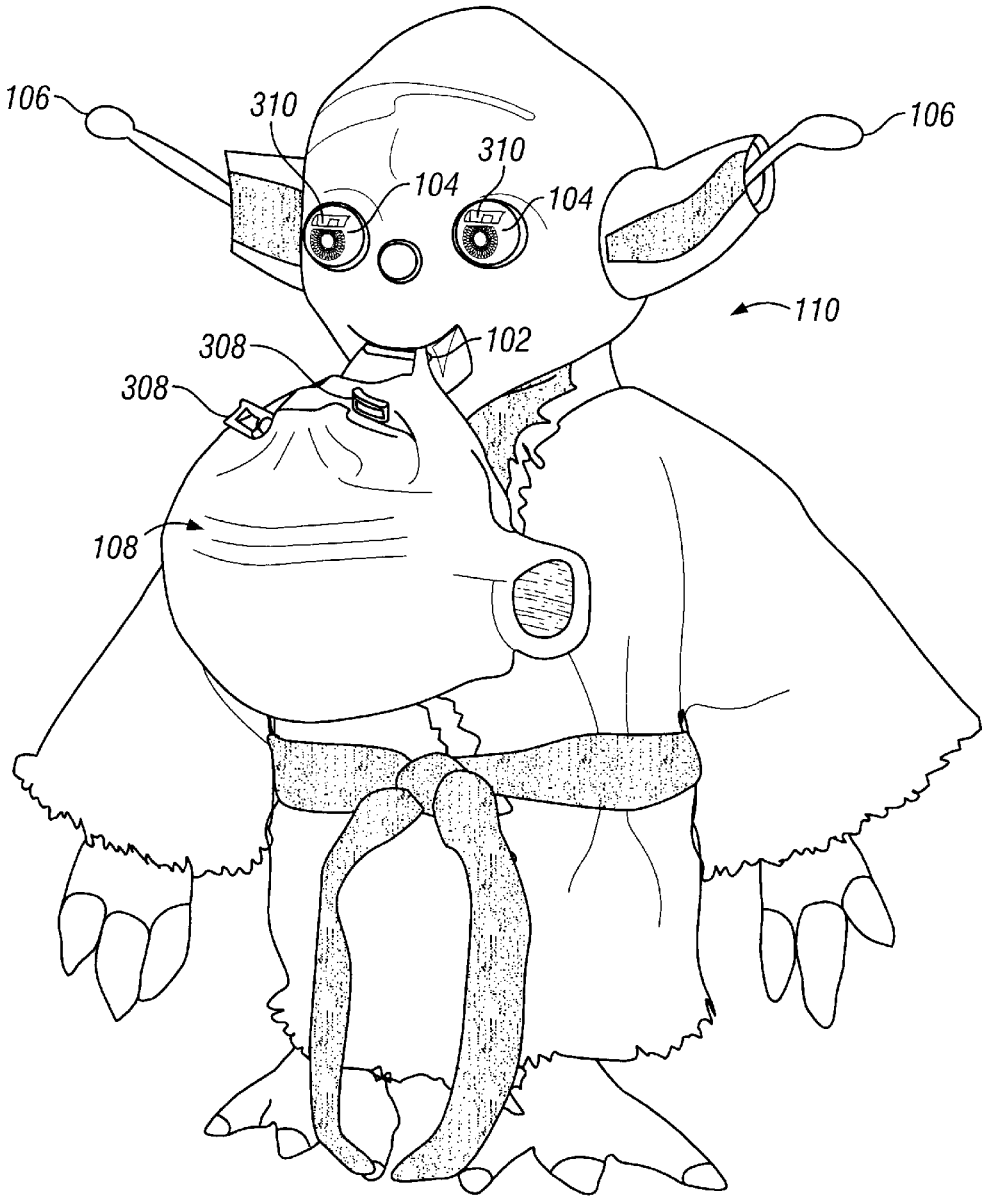
FIG. 3 is a perspective view of the toy of FIG. 1 showing a front facial area and a removed skin.

Referring also to FIG. 3, the body parts include one or more eye assemblies 104, a mouth assembly 102, and one or more ear assemblies 106. The skin 108 is shown detached from the ear assemblies 106 and the eye assemblies 104 to illustrate various features of the design and attachment of the skin 108 to the various body parts.

As shown in this figure, the skin 108 is secured to the head 110 at one or more body parts (for example, mouth assembly 102, eye assemblies 104, and ear assemblies 106) to cover the head 110.

The skin 108 includes one or more hard plastic inserts or clips 308 that are used to attach the skin 108 to the various body parts (for example, the eye assemblies 104 and the mouth assembly 102), as will be discussed in greater detail below. The clips 308 that connect the skin 108 to the body parts fit into slots 310 formed in the body parts (for example, as shown in eye assemblies 104) and snap into place with a snap fit connection. In one implementation, the clips 308 are made of a hard material such as plastic.

Figure 4:
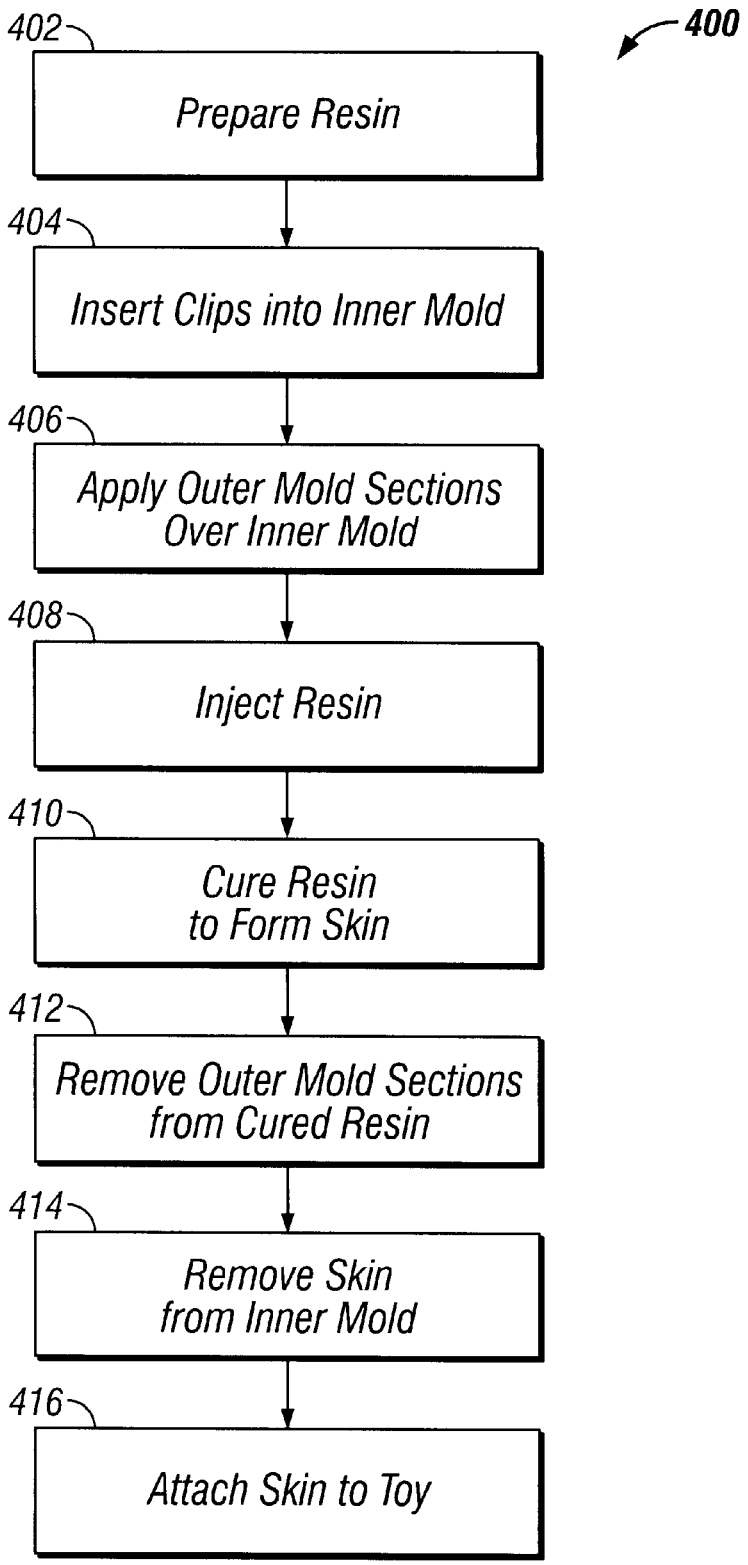
FIG. 4 is a flow chart of a process for preparing and attaching the skin to the toy of FIG. 1.

The skin 108 is prepared and attached to the head 110 according to a process 400 shown in FIG. 4. Initially in the process 400, a resin is prepared (step 402). Preparation of the resin includes modifying, as necessary, a thermoplastic elastomer with various plastics, fillers, and additives to achieve the desired realistic and durable skin characteristics.

The thermoplastic elastomer is selected to have various properties that contribute to the realistic appearance of the skin. For example, in certain implementations, the thermoplastic elastomer has a hardness in a range of about 10 to about 15 durometer on a Shore A scale. This range of hardnesses provides a thermoplastic elastomer that is both elastic and durable. Other suitable materials include latex, polyvinyl chloride, polyurethanes, silicones, Kraton, and other soft, pliable materials.

The thermoplastic elastomer is selected to be easy to process into the shape and thickness desired for the skin. For example, the elastomer may be selected to be processed by conventional injection techniques, and to be durable and elastic with a width of about 1 millimeter (mm).

The thermoplastic elastomer is selected with a relatively lower density than compounds such as PVC. For example, in one implementation, the elastomer has a density of about 0.9 to about 1.05 grams (g) per milliliter (ml).

The thermoplastic elastomer is selected to have a soft rubber feel. Additionally, the thermoplastic elastomer is selected to provide some degree of ultraviolet (UV) protection from sunlight or fluorescent light. For example, the thermoplastic elastomer may include an additive that provides UV protection. The thermoplastic elastomer may include an additive that permits decorative features, such as hair and paint, to be added to the skin later in the process 400.

The thermoplastic elastomer should be relatively inexpensive to buy, make, and/or process. This is important because the selected thermoplastic elastomer is to be used as a realistic skin on an affordable toy. A resin used in one implementation is a thermoplastic elastomer made by Suhhae Industrial Co., Ltd. and available from Trade Walker Limited of Hong Kong. This elastomer is sold under the trade name Suhhae Elastomer.

Referring also to FIGS. 5–9, after the resin is prepared (step 402), one or more clips 308 are placed into grooves 500 of an inner mold 501 (step 404). The inner mold 501 is shaped like the head 110 of the toy 100 so that after the resin has been cured and the skin is formed, the skin will fit snugly over the head 110.

Furthermore, the grooves 500 are positioned at locations on the inner mold 501 that correspond to the locations of the slots 310 into which the clips 308 fit when the skin 108 is placed over the head 110. The grooves 500 are shaped to be somewhat larger in size than the clips 308. As discussed below, the clips 308 should peel away from the inner mold 501 after the skin 108 is prepared.

The inner mold 501 may be kept at a cooler temperature than the resin or ambient air temperature so that the resin will cool upon contact with the clips 308 placed in the inner mold 501. In this way, the resin is prevented from flowing over the whole clip 308 during injection of the resin, which would render the clip 308 inoperable for its intended attachment purpose.

Figure 5:
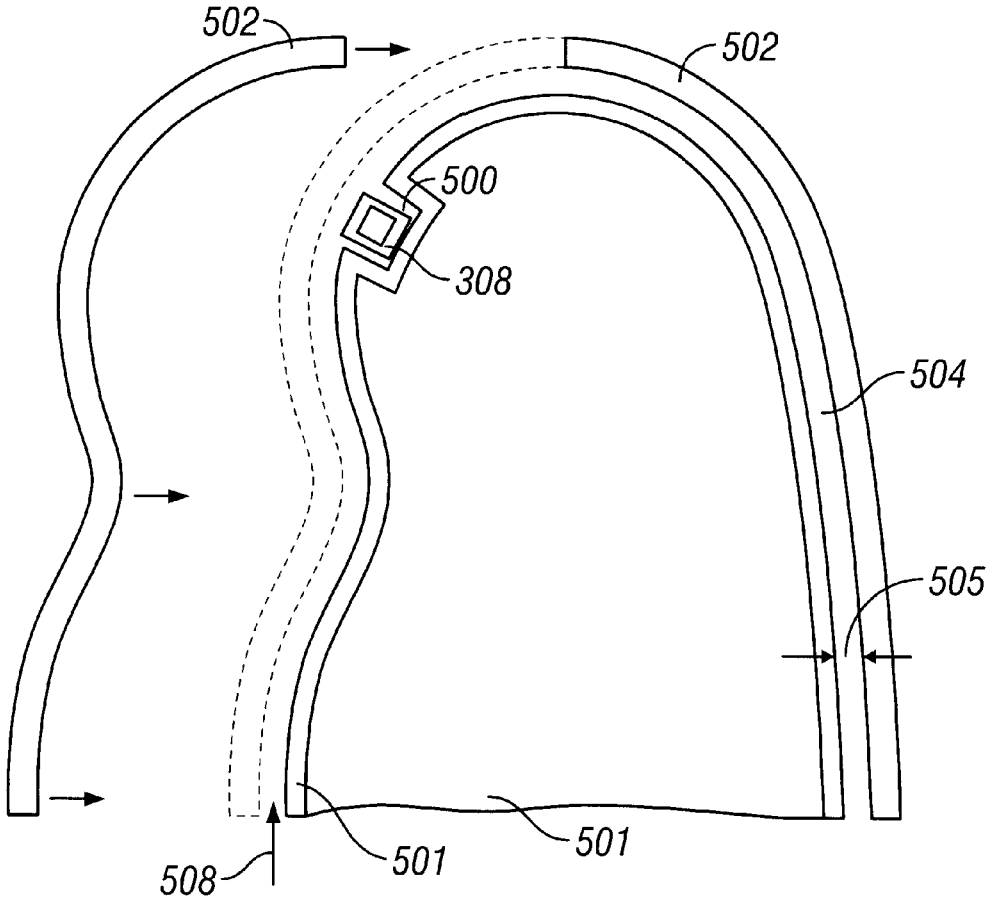
FIGS. 5–7 are cross sectional views illustrating steps in the process of FIG. 4.

After the clips 308 have been placed into the inner mold 501 (step 404), outer mold sections 502 are applied or mated together over the inner mold 501 (step 406). As shown in FIG. 5, the outer mold sections 502 are shaped with the same contours as the contour of the inner mold 501. The inner mold 501 and outer mold sections 502 may be made of any hard material such as a metal. In general, the resin will be treated or cured after it is injected into a seam 504 formed from the outer mold sections 502 applied to the inner mold 501. Thus, the inner mold 501 and/or outer mold sections 502 may be made of materials that have particular thermal properties to cure the resin. For example, the curing process may require that the outer mold section 502 be heated to a minimum temperature by a heating element.

The seam 504 formed by the inner mold 501 and outer mold sections 502 has a width 505 that corresponds to a preferred thickness 506 of the skin 108. As mentioned above, in one implementation, the thickness of the skin 108 is about 1 mm, but may range anywhere between about 0.9 mm and about 1.1 mm. If the thickness of the skin is 1 mm, then the seam width 505 should be about 1 mm.

After the outer mold sections 502 have been applied to the inner mold 501 (step 406), the resin is injected into the seam 504 (step 408) as indicated by arrow 508 in FIG. 5. Once the resin is injected into the seam 504, the resin is cured to form the skin 108 (step 410).

Figure 6:
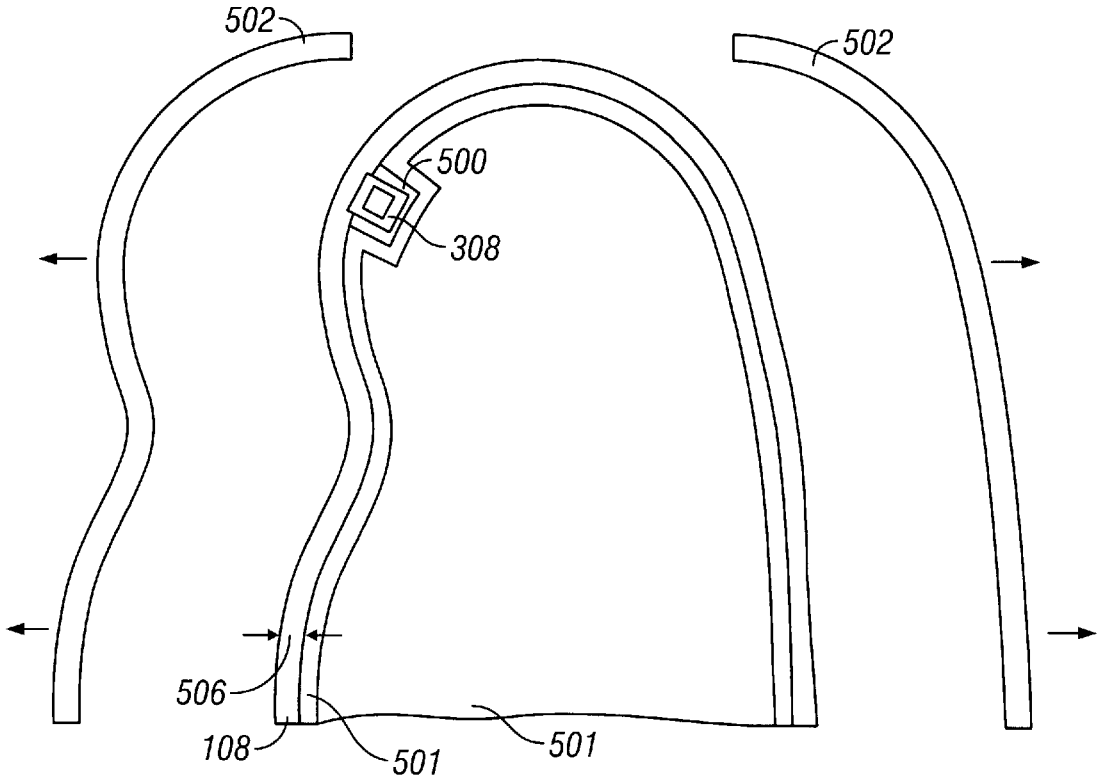

As shown in FIG. 6, following curing (step 410), the outer mold sections 502 are removed from the skin 108 (or cured resin) (step 412). It may be necessary at this time to provide a release spray or oil to the outer mold sections 502 if the skin 108 tends to stick to the outer mold sections 502. However, it is preferred that the material of the outer mold sections 502 is selected to prevent any sticking.

Figure 7:
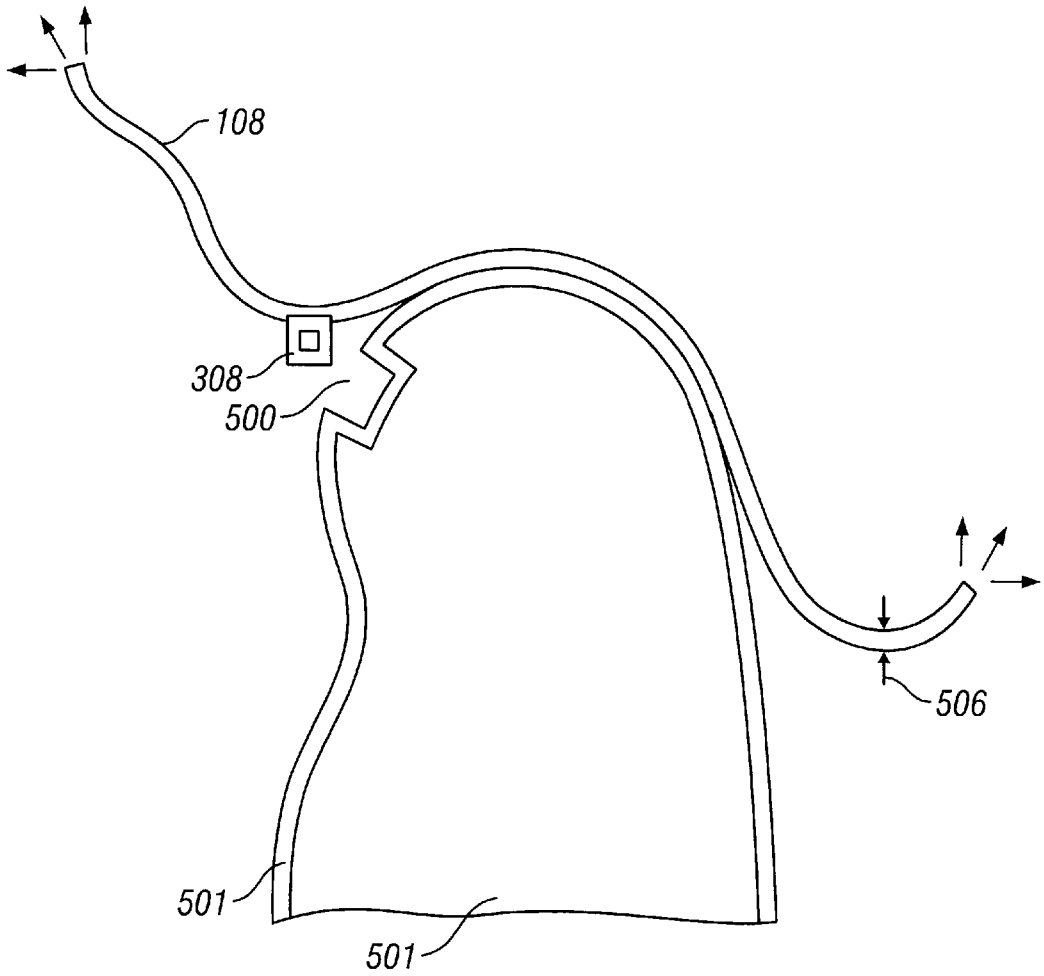
Figure 8:
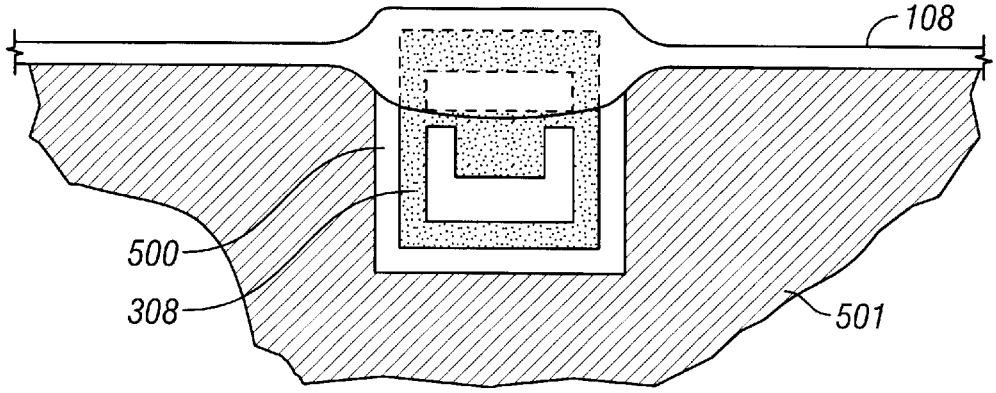
FIG. 8 shows a front cross sectional view of a clip in-molded into the skin during preparation of the skin that covers the front facial area of the toy of FIG. 1.
Figure 9:
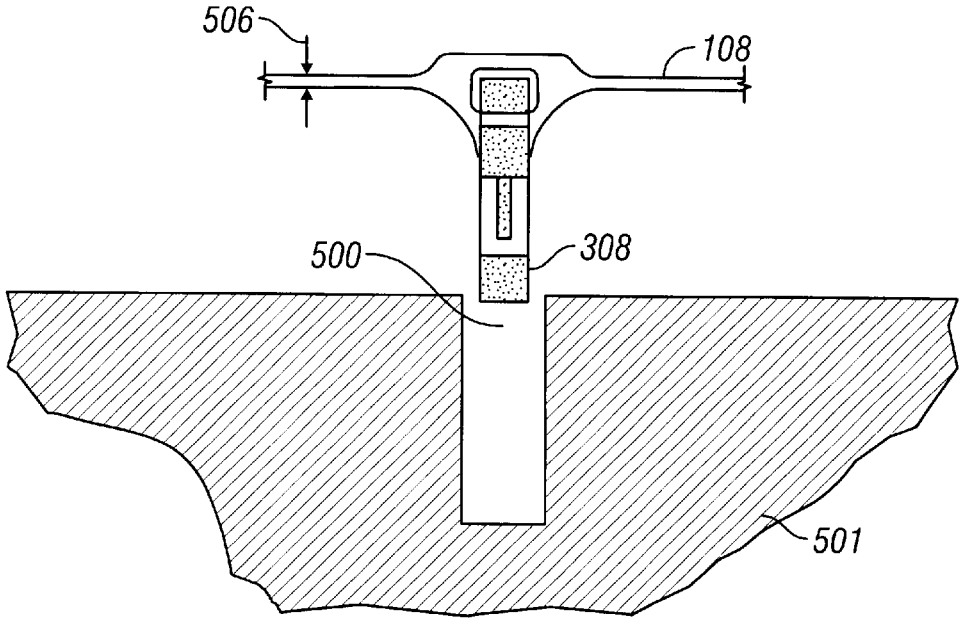
FIG. 9 shows a side cross sectional view of the clip in-molded into the skin during preparation of the skin that covers the front facial area of the toy of FIG. 1.

After the outer mold sections 502 are removed from the skin 108 (step 412), the skin 108 is removed from the inner mold 501 (step 414) as shown in FIG. 7. Because the skin 108 is made from a flexible and durable thermoplastic elastomer, it may be removed from the inner mold 501 by pulling and stretching it beyond its natural shape.

The skin 108 may now be attached to the head 110 of the toy 100 (step 416) as shown in FIG. 3. To attach the skin 108 to the head 110, the clips 308 are inserted into the slots 310 and the skin 108 is stretched over the head 110.

Because the skin 108 is attached at one or more of the body parts 102, 104, 106 using the clips 308 and the slots 310, the skin 108 moves when the underlying body part moves. For example, the skin 108 positioned above an eye assembly 104 will move in a fashion similar to an eyelid, thus producing a realistic animation and a realistic user interaction.

The resin may be prepared at any time before the resin is injected into the mold. Thus, the resin may be prepared after the clips are inserted into the inner mold or after the outer mold sections are applied over the inner mold.

Figure 10:
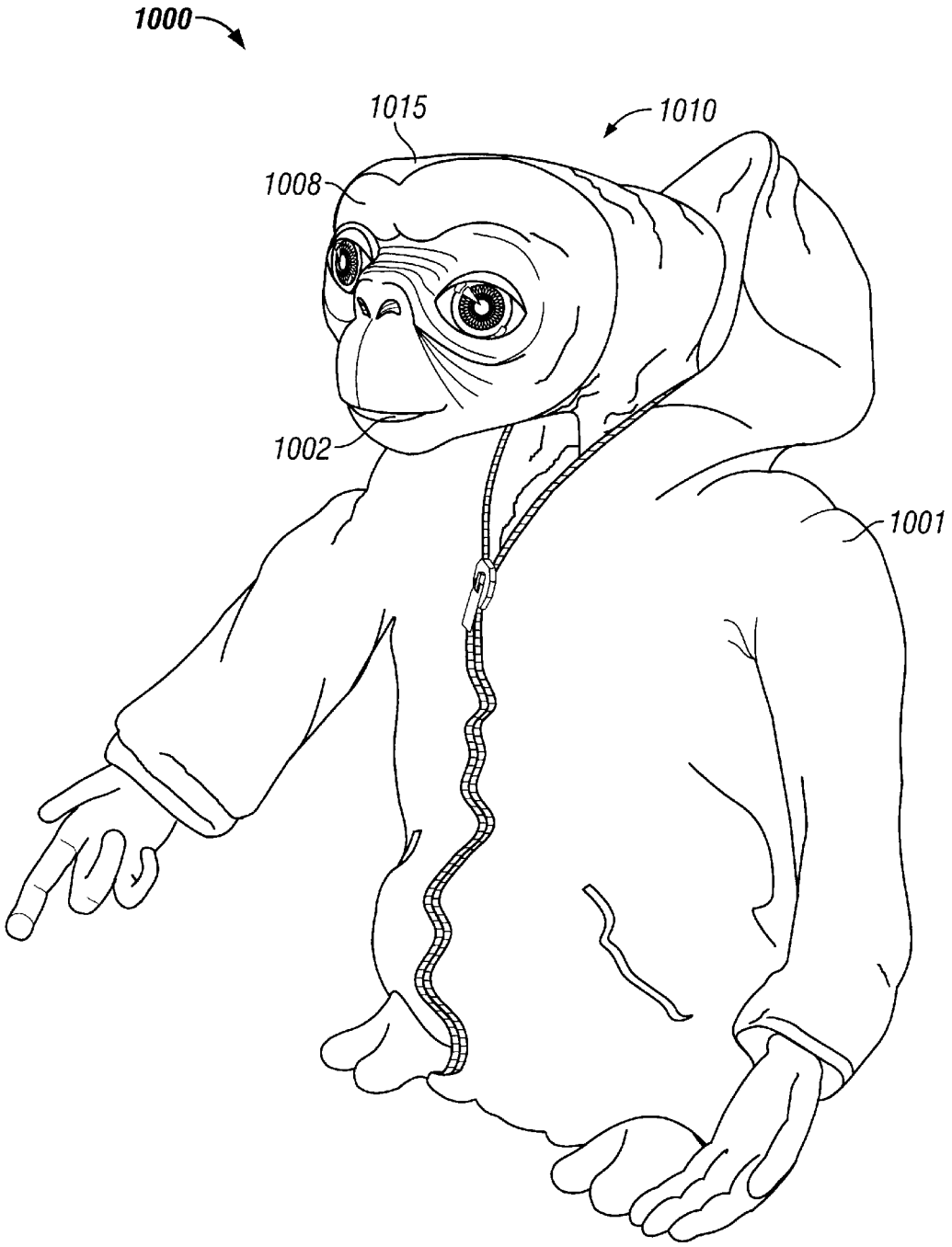
FIG. 10 is a perspective view of a toy that includes a realistic skin that covers one or more movable body parts.

Referring also to FIG. 10, in another implementation, a toy 1000 includes a body 1001 having a head 1010. The head 1010 has a front facial area 1015 having one or more movable body parts such as, for example, a movable body part in the form of a mouth 1002. The toy 1000 is designed to achieve a highly lifelike appearance while maintaining a compact size and a low cost.

Like the body parts 102, 104, 106, the body part 1002 is controlled and coordinated by an electro-mechanical drive system connected to a controller such that the body part 1002 moves in response to external conditions sensed by the controller. Additionally, like body parts 102, 104, 106, the body part 1002 may be formed of a hard polymer to permit efficient movement.

The toy 1000 also includes a skin 1008 that covers the front facial area 1015 such that parts of the skin 1008 are attached to portions of the body part 1002. Like the skin 108, the skin 1008 is formed from a soft, durable, flexible thermoplastic elastomer. In this way, the skin 1008 moves in accordance with movement of the body part 1002 to which it is attached to provide a more realistic toy 1000.

Figure 11:
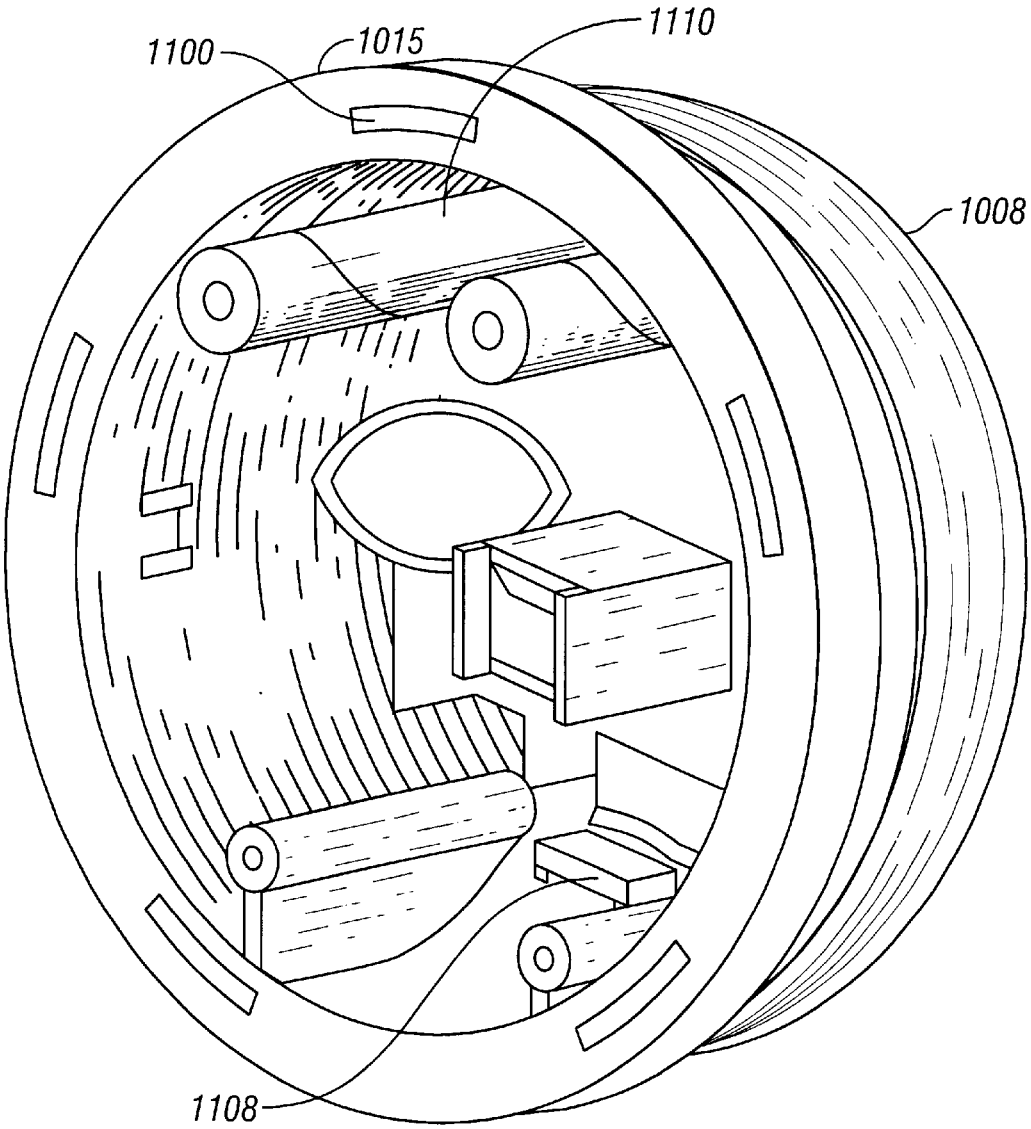
FIG. 11 is a perspective view of a front facial area removed from the toy of FIG. 10.

Referring also to FIG. 11, the front facial area 1015 is shown detached from the head 1010. The skin 1008 is molded onto a rigid piece 1100 and a clip 1108. The clip 1108 is then inserted into the body part 1002.

Figure 12:
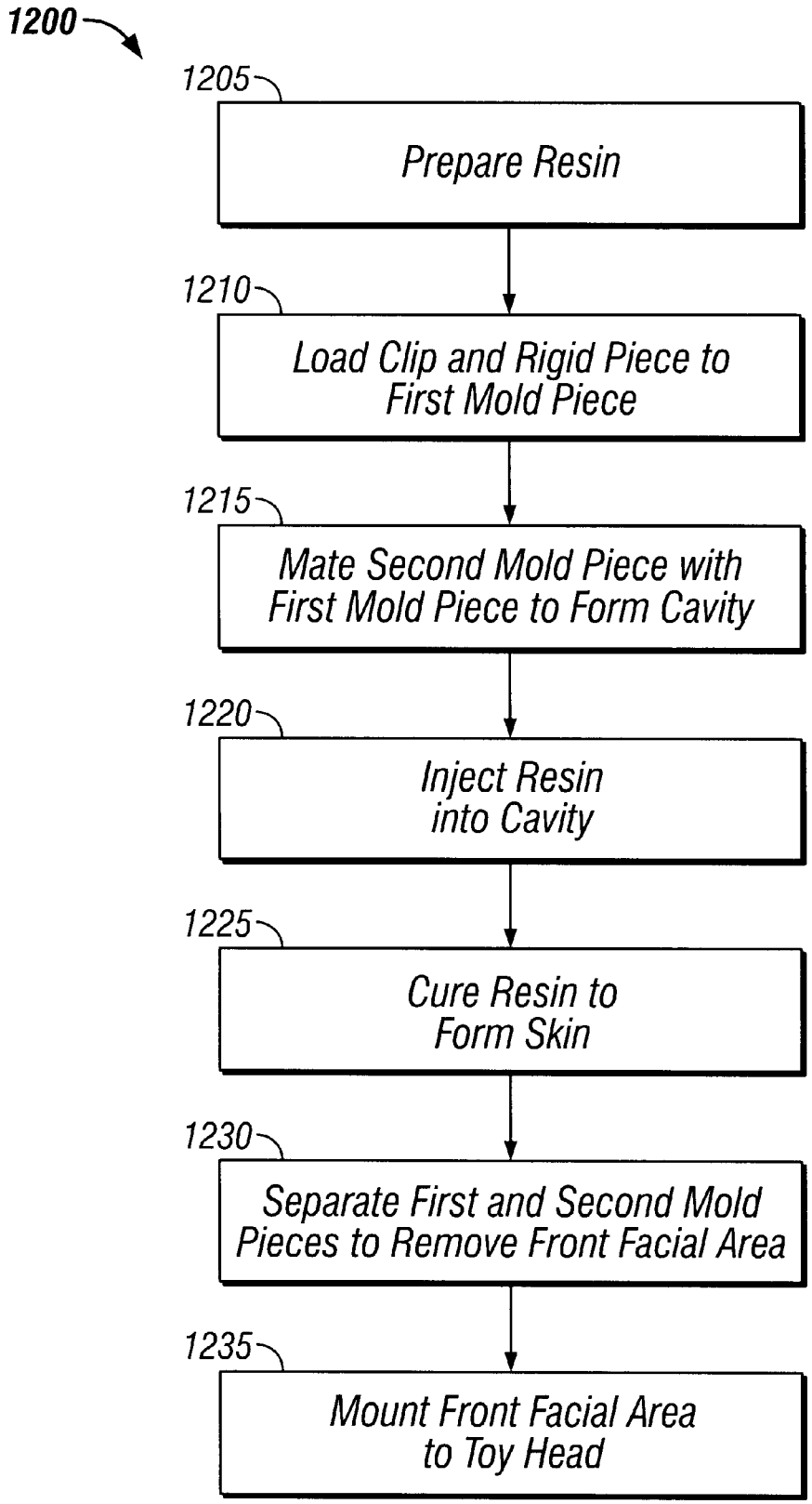
FIG. 12 is a flow chart of a process for preparing and attaching the skin to the toy of FIG. 10.

In one implementation, the skin is formed and attached to the head 1010 using a process 1200 such as is shown in FIG. 12. Process 1200 is similar in many ways to process 400 in FIG. 4 and reference is made to process 400 for additional detail. In general, in process 1200, the skin 1008 is prepared and molded to the rigid piece 1100 to form the front facial area 1015, which is then attached to the head 1010.

Figure 13:
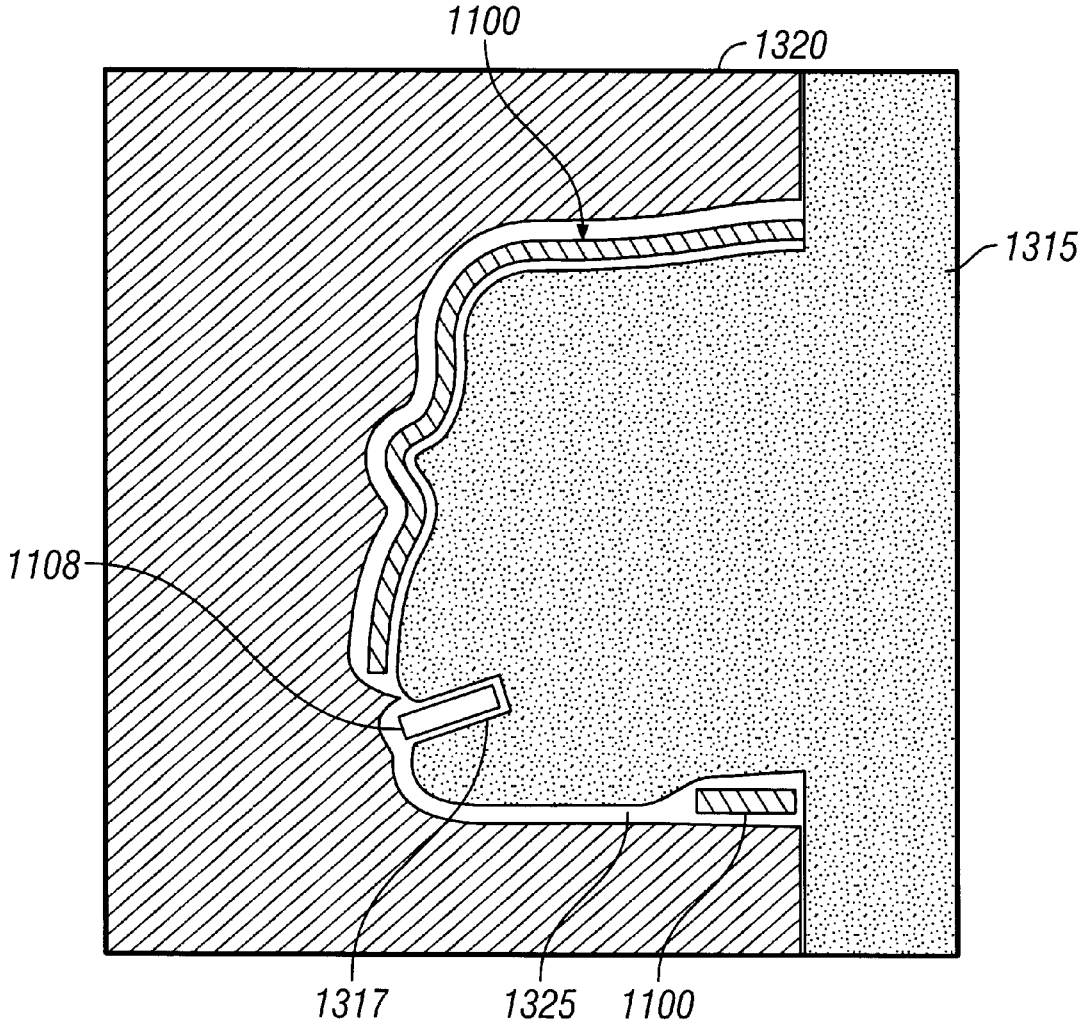
FIGS. 13 and 14 are cross sectional views illustrating steps in the process of FIG. 12.
Figure 14:
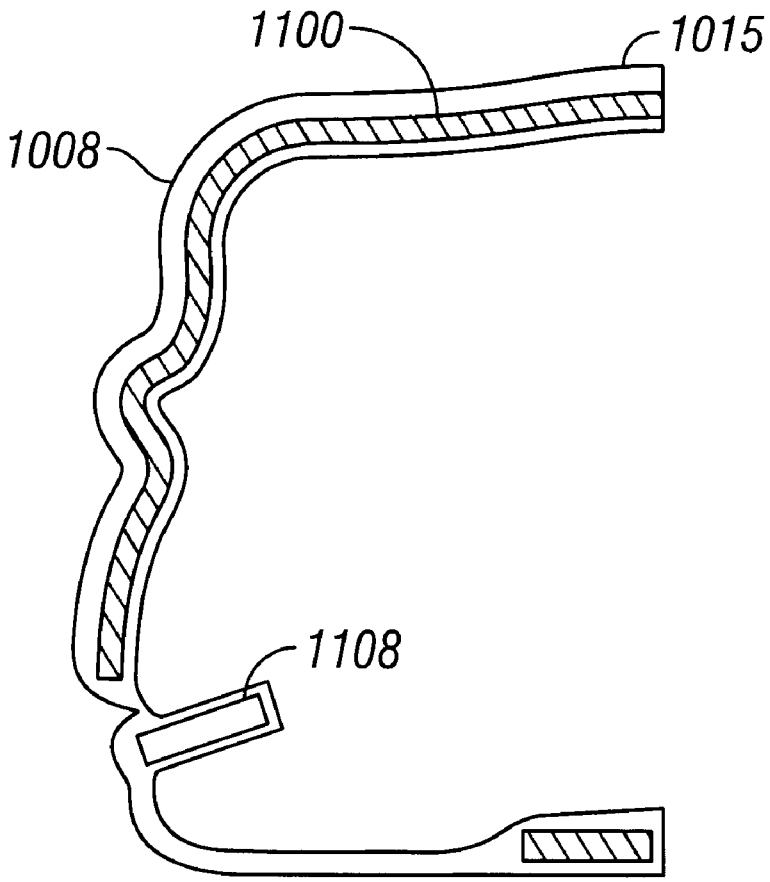

As an initial step in the process 1200, a resin is prepared (step 1205). Details of how the resin is prepared are discussed above with respect to FIG. 4. Referring also to FIGS. 13 and 14, the rigid piece 1100 is placed onto a first mold piece 1315 and the clip 1108 is inserted into a groove 1317 formed in the first mold piece 1315 (step 1210). The first mold piece 1315 performs a similar function as inner mold 501 as detailed above with respect to the process 400. Then, a second mold piece 1320 is mated with the first mold piece 1315 to form a cavity 1325 (step 1215). The rigid piece 1100 and first mold piece 1315 are shaped such that, after the resin is cured and the skin is formed, the skin molds to the rigid piece 1100 to form the front facial area 1015. Additionally, the first mold piece 1315 is shaped to facilitate attachment of the front facial area 1015 to the head 1010. Thus, for example, the first mold piece 1315 may include cavities (not shown) for receiving protrusions 1110 formed along an inner surface of the rigid piece 1100.

Next, the resin is injected into the cavity 1325 formed by the first and second mold pieces 1315, 1320 to flow throughout the cavity 1325 and around the clip 1108 and rigid piece 1100 (step 1220). The resin is cured to form the skin (step 1225). Next, after the resin has cooled, the first and second mold pieces 1315, 1320 are separated (step 1230) to form a seamless front facial area 1015. The front facial area 1015 is then mounted to the head 1010 by attaching the protrusions 1110 to mating connectors (not shown) on the head 1010 and by inserting the clip 1108 into a slot associated with the body part 1002 much like the clips 308 are inserted into slots 310 (step 1235).

Because the skin 1008 is molded to the rigid piece 1100 and the skin 1008 is attached to the body part 1002 using the clip 1108, the skin 1008 covering the body part 1002 and not molded to the rigid piece 1100 moves when the body part 1002 moves. Such a design produces a realistic animation and a realistic user interaction. Moreover, the front facial area 1015 has a more consistent thickness because at least a portion of the skin 1008 is molded to the rigid piece 1100. Such a design provides varied surface features, such as undercuts and complex contours.

A number of implementations have been described. Nevertheless, it will be understood that various modifications may be made without departing from the spirit and scope of the invention. For example, advantageous results still could be achieved if steps of the disclosed techniques were performed in a different order and/or if components in the disclosed systems were combined in a different manner and/or replaced or supplemented by other components. Accordingly, other embodiments are within the scope of the following claims.

For example, other techniques may be used to secure the skin to the mechanism. These techniques include, for example, gluing the skin to the mechanism, gluing the clips to the skin, attaching a tab molded into the skin to the mechanism, trapping the skin or clips between parts of the mechanism, and welding. In another approach, a housing/skeleton may be insert molded with the skin.

Other techniques may be used to form the skin such as, for example, rotational molding.

The skin may be formed with areas built in for flexibility and for material to accumulate. Thicker regions of the skin may be used to prevent undesired movement.

What is claimed is:

1. A toy comprising:

a body including a fixed part;

a movable part secured to the fixed part and having an opening;

a flexible elastomer skin that covers at least a portion of the fixed part and couples to the movable part; and an attachment piece that is attached to the flexible elastomer skin and is inserted into the opening of the movable part;

wherein the attachment piece couples the flexible elastomer skin to the movable part;

wherein the flexible elastomer skin moves in response to movement of the movable part.

2. The toy of claim 1, wherein the flexible elastomer skin has a hardness in a range of 10 to 15 durometer on a shore A scale.

3. The toy of claim 1, wherein the flexible elastomer skin is a thermoplastic.

4. The toy of claim 1, wherein the flexible elastomer skin has a thickness of 0.8 mm to 1.2 mm.

5. The toy of claim 1, wherein the flexible elastomer skin is made of styrene butadiene styrene.

6. The toy of claim 1, wherein the flexible elastomer skin is made of styrene ethylene-butylene styrene.

7. The toy of claim 1, wherein the flexible elastomer skin is made from a combination of styrene butadiene styrene and styrene ethylene-butylene styrene.

8. The toy of claim 1, wherein the flexible elastomer skin has a specific gravity of 0.9 to 1.05.

9. The toy of claim 1, further comprising sensors that detect sensory inputs and generate signals.

10. The toy of claim 9, wherein the sensors include motion, auditory, and light sensors.

11. The toy of claim 9, wherein the sensors include sensors that detect pressure applied to the toy.

12. The toy of claim 9, wherein the sensors include sensors that detect a tilting of the toy.

13. The toy of claim 9, further comprising:

an electro-mechanical system that drives the movable part; and a controller that detects the generated signals from the sensors, and in response to the generated signals, activates the electro-mechanical system to move the movable part.

14. The toy of claim 1, wherein the fixed part has a shape of a head.

15. The toy of claim 1, wherein the movable part has a shape of an eye.

16. The toy of claim 1, wherein the movable part has a shape of an ear.

17. The toy of claim 1, wherein the movable part has a shape of a mouth.

18. The toy of claim 1, wherein the flexible elastomer skin that covers at least the portion of the fixed part is molded to the portion of the fixed part.

19. The toy of claim 1, wherein the flexible elastomer skin that covers at least the portion of the fixed part is removable from the portion of the fixed part.

20. The toy of claim 1, wherein the opening includes a slot and the attachment piece is inserted into the slot using a snap fit connection.

21. A toy comprising:

a body including a fixed part;

a movable part secured to the fixed part;

a flexible elastomer skin that covers at least a portion of the fixed part and couples to the movable part; and an attachment piece that couples the flexible elastomer skin to the movable part, wherein the flexible elastomer skin is insert molded to the attachment piece and the attachment piece is connected to the movable part, wherein the flexible elastomer skin moves in response to movement of the movable part.

22. A toy comprising:

a body including a fixed part;

a movable part secured to the fixed part; and a front facial area that covers at least a portion of the fixed part, the front facial area comprising:

a rigid piece that attaches the front facial area to the portion of the fixed part, and a flexible elastomer skin molded to the rigid piece and coupled to the movable part;

wherein the flexible elastomer skin coupled to the movable part moves in response to movement of the movable part.

23. The toy of claim 22, in which the flexible elastomer skin is molded to the rigid piece using injection molding.

24. The toy of claim 22, in which the front facial area further comprises an attachment piece that couples the flexible elastomer skin to the movable part, wherein the flexible elastomer skin is molded to the attachment piece.

25. The toy of claim 24, in which the flexible elastomer skin is injection molded to the attachment piece.

* * * * *